US006002417A

United States Patent [19]

No

[11] Patent Number: 6,002,417

[45] Date of Patent: Dec. 14, 1999

[54] METHOD AND APPARATUS FOR DYNAMICALLY SIZING AND OPERATING ENABLE GROUPS OF THERMAL ELEMENTS IN A PRINTER

[75] Inventor: Young No, Pittsford, N.Y.

[73] Assignee: Eastman Kodak Company, Rochester, N.Y.

[21] Appl. No.: 09/010,802

[22] Filed: Jan. 23, 1998

[51] Int. Cl.[6] ..... B41J 2/32

[52] U.S. Cl. ..... 347/182; 347/180; 347/211

[58] Field of Search ..... 347/211, 180, 347/181, 182; 400/120.05, 120.06

[56] References Cited

U.S. PATENT DOCUMENTS

| | | | |
|---|---|---|---|
| 4,564,749 | 1/1986 | Ishima . | |
| 5,072,237 | 12/1991 | Takaoka | 347/181 |
| 5,159,693 | 10/1992 | Tatsuzawa | 347/181 |
| 5,353,043 | 10/1994 | Akiyama | 347/181 |
| 5,382,101 | 1/1995 | Iguchi . | |
| 5,442,381 | 8/1995 | Fukubeppu et al. | 347/182 |

FOREIGN PATENT DOCUMENTS

WO 96/32273 10/1996 WIPO .

*Primary Examiner*—Huan Tran

*Attorney, Agent, or Firm*—Walter S. Stevens

[57] ABSTRACT

Both a method and apparatus are provided for sizing and operating enable groups of thermal elements in a thermal printer to allow the printer to be operated by power sources having outputs too small to operate all of the thermal elements simultaneously. Prior to the printing operation, the maximum number of thermal elements that can be actuated by the output of the power source is determined, and then divided into the total number of thermal elements. Next, the resulting quotient is rounded up into the nearest integer in order to ascertain the number of enable groups. The number of enable groups is then divided into the total number of thermal elements to determine the size of each enable group. During the printing operation, streams of non-actuating data are multiplexed into the stream of image data to create virtual enable groups wherein the number of thermal elements actuatable by the image data is no greater than the number of thermal elements in any of the enable groups at any time during the printing operation, thereby preventing the power source from being overtaxed.

20 Claims, 5 Drawing Sheets

METHOD AND APPARATUS FOR DYNAMICALLY SIZING AND OPERATING ENABLE GROUPS OF THERMAL ELEMENTS IN A PRINTER

BACKGROUND OF THE INVENTION

This invention generally concerns a method and apparatus for dynamically sizing and operating enable groups of thermal elements in a printer to allow it to operate with a variety of power sources having different outputs.

Thermal printers include a single row of thermal elements for printing a single line of an image onto a print medium such as paper. Each thermal element is in reality an electrical resistance heater that fuses dye from a donor onto the print medium. As such, each element draws a significant amount of electrical current whenever it is actuated. As the number of thermal elements in the printhead of such a printer may number between 512 to several thousand, a large capacity power source is necessary if all of the thermal elements are to be driven simultaneously. To obviate the need for such a large capacity power source, it is known in the prior art to wire the thermal elements so that they are divided into two or more enable groups which may be operated at different times. The use of such enable groups allows the printhead to be driven by a power source whose maximum output is insufficient to actuate all of the thermal heating elements at once. In operation, current from the power source is sequentially multiplexed to the thermal elements in each of the enable groups, each group of which is small enough to be actuated by the power source without overtaxing it. The division of the thermal elements into such enable groups advantageously allows the printer to be powered by a smaller and less expensive power source than would otherwise be necessary at the expense of a longer printing time.

Unfortunately, there are a number of shortcomings associated with the hard wiring of the thermal elements into a fixed number of enable groups. However, before these shortcomings can be fully appreciated, some background as to the overall structure and operation of such thermal printers is necessary.

The thermal elements in such printers are intermittently connected to the power source via switches in the form of NAND gates. The NAND gates either connect or disconnect their respective thermal elements to the power source in response to "0" or "1" data bits received from a latch circuit. Each of the latch circuits is in turn connected to a one-bit wide gate of a shift register which receives a stream of image data from a microprocessor. In operation, the shift register serially loads data bits from the stream of image data into the latch circuits through its gates in accordance with clock pulses supplied by the microprocessor. In a six-bit printer, 64 possible data in the form of "1s" and "0s" are admitted through each shift register gate for every line printed by the thermal printhead, which in turn allows the printhead to generate 64 different shades of a color per pixel.

In a printhead having 512 resistive printing elements, each of the elements requires approximately 48 milliamps at 24 volts every time it is actuated by a "1" signal relayed to its respective NAND gate via a latch circuit. If all of the thermal elements were actuated simultaneously, the load on the power source would be 24.6 amps. As many power sources are not capable of delivering such a current, the thermal elements in some prior art printheads were divided into enable groups which were sequentially operated in order to reduce the load on the power source. For example, if it was desired to utilize a power source having a 6.5 ampere capacity at 24 volts, the 512 thermal elements of the printhead would be hard-wired into four enable groups of approximately 128 elements each. In operation, current from the power source would be serially multiplexed to each of the four enable groups to complete a line of printing before the paper and the dye donor were moved relative to the printhead in anticipation of the printing of the next line of the image.

While the hard-wiring of the switching circuits into a specific number of enable groups allows a printhead to operate off of a smaller and less expensive power source, it also complicates both the structure and operation of the printhead. For the smaller-capacity power source to sequentially activate the thermal elements in a particular enable group, the base lead of each of the NAND gates must be connected to different wires to allow the multiplexing of electrical power. The microprocessor needs to generate not only the NAND-gate controlling image data stream, but also the multiplexing commands necessary to sequentially operate the enable groups. Most importantly, such hard-wiring creates a fixed number of enable groups that limits the use of the printhead to a particular power source. Such prior art printheads cannot be used at all with a power source that does not have the capability of operating at least one of the enable groups. This is particularly problematical in prior art printheads that have few or only one enable group. Conversely, if such a prior art printhead is used in conjunction with a higher capacity power source, it may not be possible to increase the speed of printing even by modifying the multiplexing signals generated by the microprocessor.

Clearly, there is a need for a thermal printhead which is not only capable of being used by power sources having substantially different outputs, but which also makes optimal use of the power received in terms of print speed when connected to a higher output power source.

SUMMARY OF THE INVENTION

Generally speaking, the invention is both a method and apparatus for sizing and operating an enable group of thermal elements in a thermal printer that overcomes the shortcomings associated with the prior art. In the method of the invention, the maximum number of thermal elements actuatable by the maximum power output of the power source is first determined. Next, during the printing operation, non-actuating data is introduced into the image data so that the number of thermal elements actuatable by the image data is no greater than the maximum number actuatable. Preferably the stream of non-actuating data is multiplexed into the image data.

To determine an enable group size, the maximum number of thermal elements actuatable is divided into the total number of thermal elements. The resulting quotient is rounded up to the nearest integer to calculate the number of enablement groups. Finally, the number of enablement groups is divided into the total number of thermal elements to determine the number of thermal elements in each group.

In the preferred method, each of the thermal elements of the printhead is assigned to one of the enable groups, which are adjacent to and mutually exclusive of each other. In one embodiment of the method, the non-actuating data stream is multiplexed such that every heating element in one enable group is actuatable by image data. In a more preferred method, the non-actuating data stream is multiplexed into the image data stream in such a fashion that some of the thermal elements of each of the enable groups are actuatable by the image data at any one time while the remainder of the elements are maintained in a non-actuated stated. This embodiment of the method advantageously avoids unwanted "border pixel" effects where excess dye may be deposited at the borders between groups as a result of collective radiant heat generated by the group.

The apparatus of the invention comprises a power source, a row of thermal elements actuatable by the power source in response to signals generated by a stream of image data, a sensor connected to an output of the power source for determining a maximum output thereof, and a processor connected to the output of the sensor for both determining the maximum number of thermal elements actuatable by the maximum output of the power source, and for multiplexing non-actuated data streams into the image data stream during a printing operation so that the number of thermal elements actuated is no more than the maximum number of elements actuatable by said source.

Prior to operation, the processor determines a maximum enable group size by sensing the number of thermal elements that can be actuated without causing a drop in the voltage of the electrical output. This maximum number of elements is divided into the total number elements, and the resulting quotient is rounded up to the nearest integer to obtain the total number of enable group. This integer is then divided into the total number of thermal elements to calculate the total number of elements per group. In operation, the processor preferably multiplexes the non-actuating data stream into the image data stream so that some of the elements of each of the enable groups are actuatable at all times during the printing operation.

Both the method and apparatus of the invention provide a printer having a simplified printhead structure which may be operated at maximum speed by a variety of power sources having different capabilities without the need for structural changes or power adapters.

DETAILED DESCRIPTION OF THE INVENTION

Figure 1:
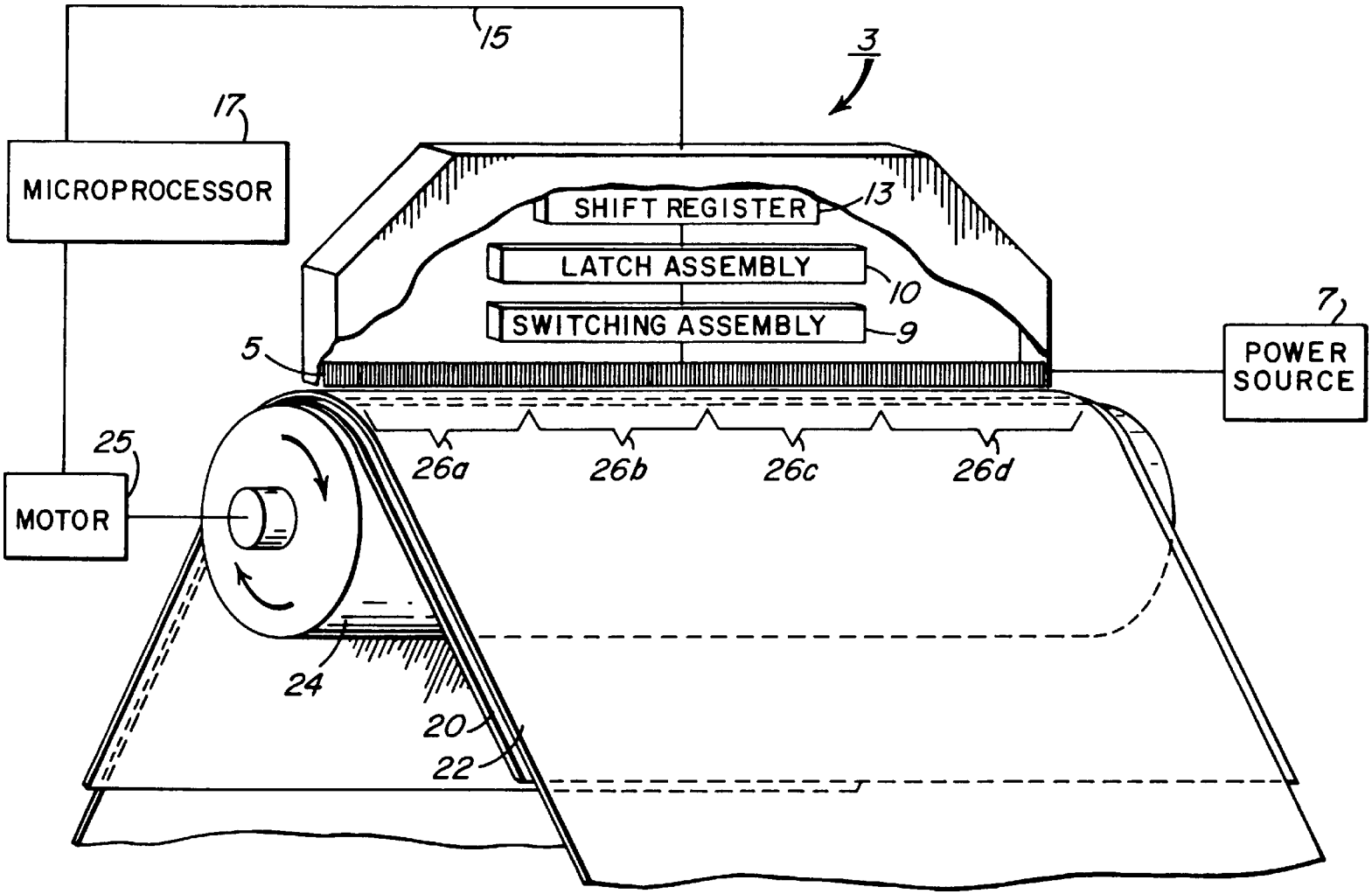
FIG. 1 is a semi-schematic drawing of a thermal printer, illustrating the principal components involved in implementing the method.

With reference now to FIG. 1, wherein like numerals designate like components throughout all of the several figures, a printer 1 adapted for use with the invention includes a printhead 3 having a row of thermal elements 5. The printer 1 may have between 512 to several thousand thermal elements 5 depending upon the degree of pixel resolution desired.

Figure 2:
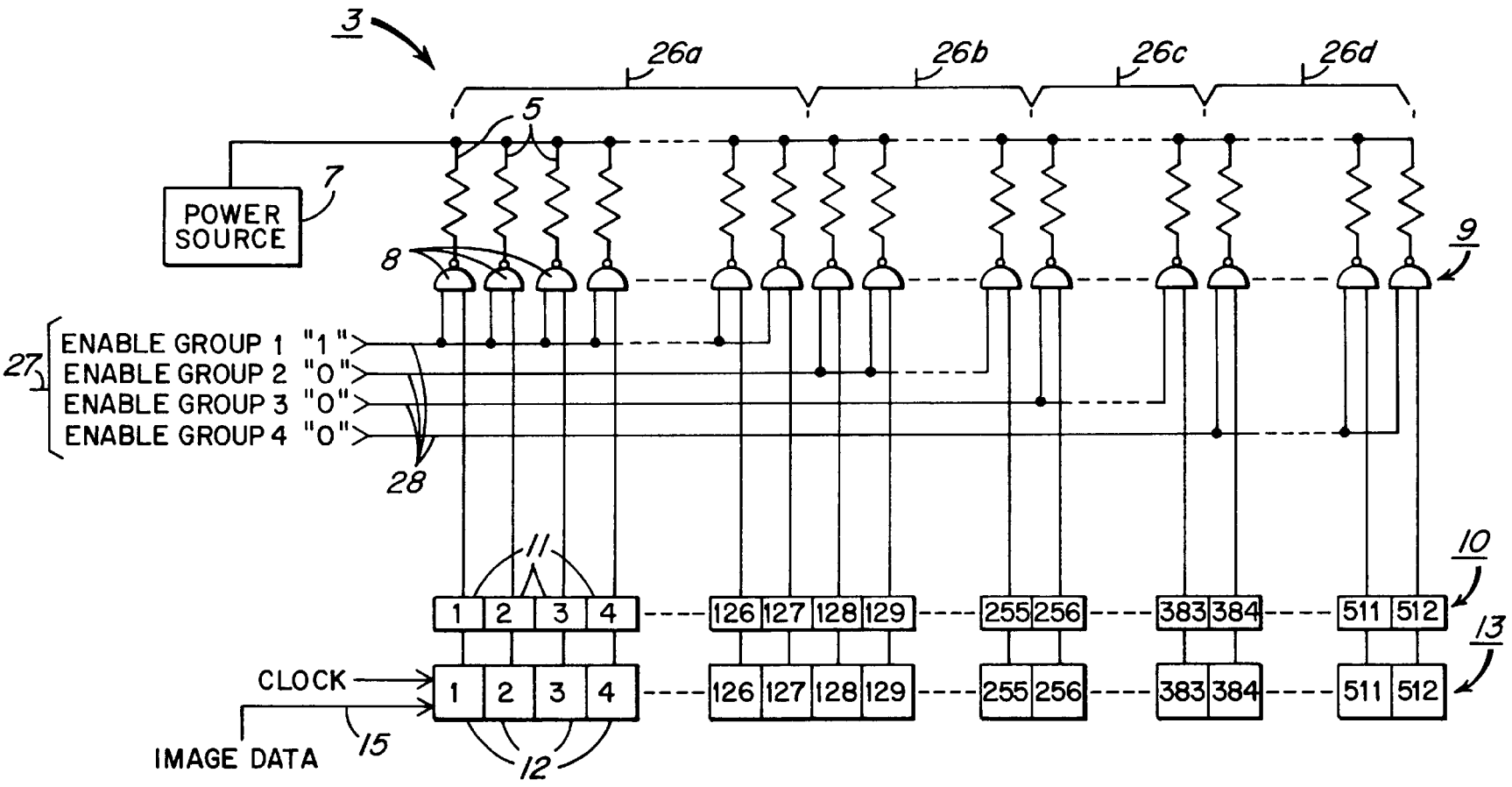
FIG. 2 (PRIOR ART)
FIG. 2 is a schematic diagram of a prior art printhead that could be used in the printer illustrated in FIG. 1, hard-wired to divide the thermal elements into four separate enable groups.

With reference now to FIGS. 1 and 2, each of the thermal elements 5 is connectable to a power source 7 via an individual NAND gate 8 of a switching assembly 9. Each of the NAND gates 8 is actuated by a "close gate" or "open gate" digital signal in the form of either a "1" or "0" relayed to it from a specific latch circuit 11 of a latch assembly 10. Each of the latch circuits 11 in turn receives its "close gate" or "open gate" digital signals from one of the one-bit gates 12 of a shift register 13. Finally, the shift register 13 receives the data-bit signals that it loads into the gates 12 from a stream of image data 15 generated by a microprocessor 17.

The printhead 3 of the printer 1 generates an image on a printing medium, such as a sheet of thermal paper 20, by selectively actuating the thermal elements 5 over a dye ribbon 22 that overlies the paper 20. The dye ribbon 24 is independently movable over the paper 20 by spooling rollers (not shown) and includes serially connected areas of cyan, magenta, and yellow dyes that are fusible onto the paper 20 when touched by an actuated heating element 5. A rotatably mounted platen roll 24 supports both the thermal paper 20 and the dye ribbon 22 as shown. The roll 24 is connected to an electric motor 25 which is controlled by the microprocessor 17 to incrementally rotate the platen roll 24 every time the row of thermal elements 5 completes the printing of a horizontal line of the image to place the row of thermal elements 5 over a new location on the paper 20.

In the example of the printer 1 illustrated in FIG. 1, there are 512 thermal elements 5, and the microprocessor 17 is programmed to supply a six-bit data number per thermal element 5 per row of printing. As the darkness or lightness of the color of a particular pixel is dependent upon the amount of time that one of the thermal elements 5 is heated, the six-bit capacity of the thermal printer 1 of the invention allows the printhead 3 to provide 64 shades of cyan, yellow, and magenta for each pixel of the printed image.

Figure 3:
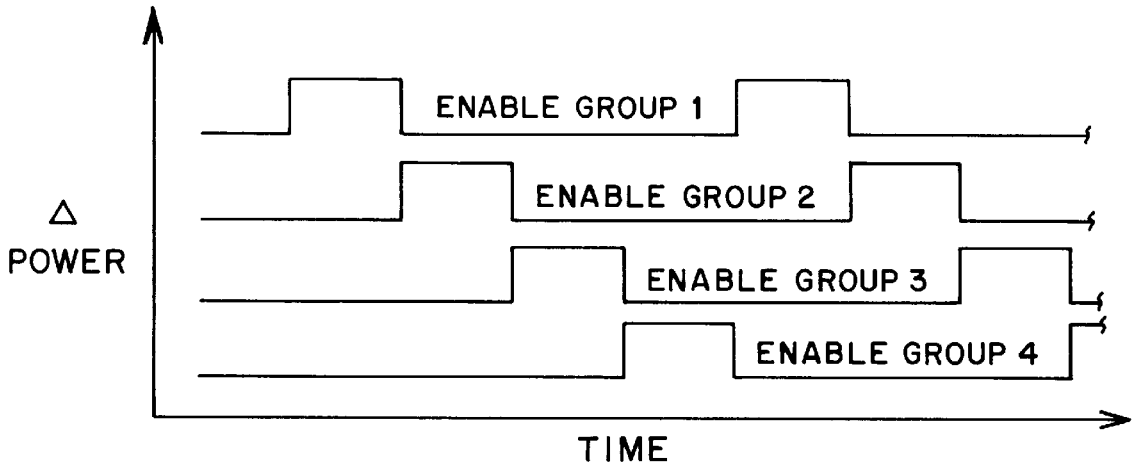
FIG. 3 (PRIOR ART)
FIG. 3 is a graph illustrating the function of the prior art printhead illustrated in FIG. 2 in terms of the electric power drawn by each of the four enable groups as a function of time.

With reference now to FIGS. 2 and 3, prior art printheads divide the thermal elements 5 into two or more enable groups 26*a–d* by the provision of specific enable group wiring 27 connected to the drain leads of the NAND gates 8. Wiring 27 sequentially conducts multiplexed switching signals 28 from the microprocessor 17 to the thermal elements 5 of each enable group 26*a–d*. In the particular example illustrated in FIG. 2, each of the thermal elements 5 requires approximately 48 milliamps at 24 volts whenever its respective NAND gate 8 is closed in response to a "1" received by its source lead from its respective latch circuit 11, and a "1" received by the drain lead through the enable group wiring 27. There would be no need for dividing the thermal elements 5 into enable groups if the power source 7 had a current capacity of 24.6 amps at 24 volts. However, if it is desired to operate the printhead 3 with a less expensive 24 volt power source 7 having a current capacity of only 6.5 amps, then it is necessary to divide the thermal elements 5 into four enable groups 26*a–d* to avoid over-taxing the power source 7. If the thermal elements 5 are so divided, each of the four groups 26*a–d* would draw, at a maximum, no more than 6.15 amps, which is well within the capacity of the 6.5 amp power source 7.

Power is sequentially made available to all of the heating elements 5 in a particular enable group 26*a–d* via multiplexed switching signals 28 in the form of "1s" and "0s" from the microprocessor 17 which are conducted through the previously-mentioned enable group wiring 27. In the scheme of multiplexing illustrated in FIG. 3, the power is serially made available to each one of the contiguous, mutually exclusive enable groups 26*a–d*. Such a design allows a less expensive power source 7 to operate a thermal printhead 3, albeit at a time expense proportional to the number of enable groups created by the multiplex wiring 27. Unfortunately, such a printhead design is useful only with a power source 7 having a specific current output. It is not useable at all with a power source having a smaller output (i.e., 5 amps). And if a power source of greater output is used, there is no concurrent advantage realized in time savings, unless the out was at least twice or four times as much as the original power source 7. In such a case, it may be possible to reprogram the microprocessor to generate switching signals 28 which enable two or all of the four groups 26*a–d* at one time, thereby doubling or quadrupling the printing speed. But, in cases where a larger available power output falls in between such multiple values (for example, 1.5 times the output of the original power source 7) it would not be possible to realize all of the potential time savings in printing regardless of how the microprocessor 17 were reprogrammed.

Figure 5:
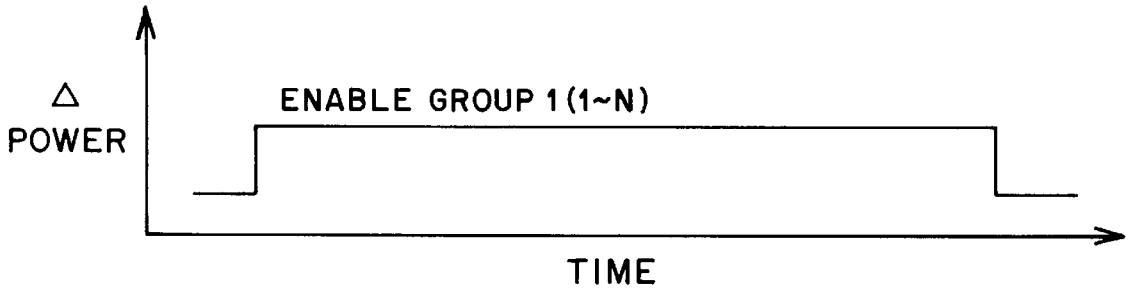
FIG. 5 is a graph illustrating the operation of the printhead of FIG. 4 as a function of power drawn over time.
Figure 4:
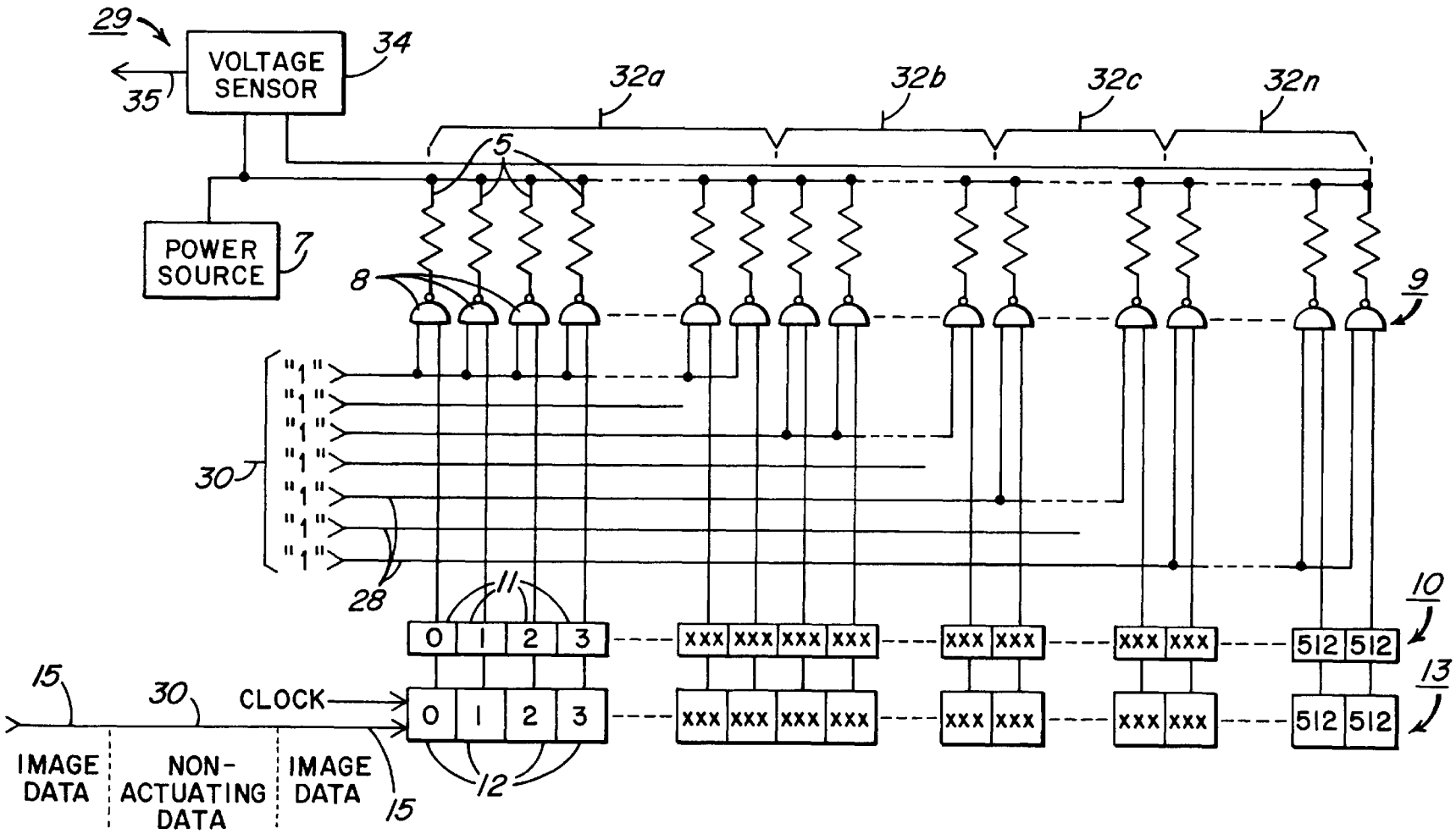
FIG. 4 is a printhead for use in the printer illustrated in FIG. 1 which has been wired in conformance with the invention so as to divide the thermal elements into any one of a number virtual enable groups.
Figure 6:
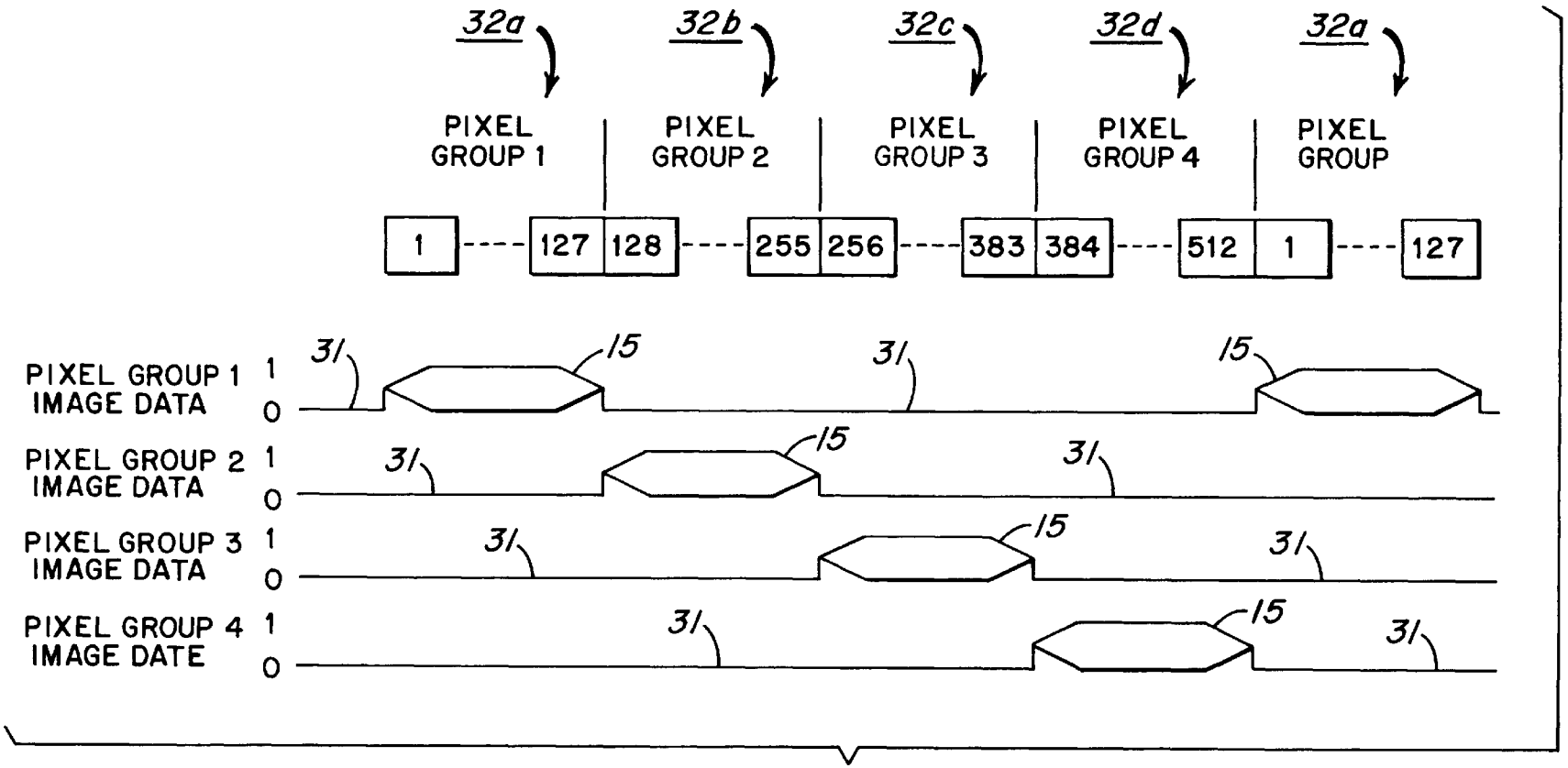
FIG. 6 is a diagram illustrating the manner in which the microprocessor of the printer illustrated in FIG. 1 multiplexes a stream of non-enabling data into the stream of image data to create any selected number of virtual enable groups.

By contrast, the printhead 29 and method of the invention illustrated in FIGS. 4, 5, and 6 affords much greater operational flexibility and potential time savings without the need for enable group wiring. All of the drain leads of the NAND gates 8 are connected to a single enablement conductor 30 that continuously conducts a "1" switching signal to the NAND gates 8 from the microprocessor 17 during their operation. As is best seen in FIG. 6, the printhead 29 of the invention does not operate by the multiplexing of enable switching signals through a specific pattern of enable group wiring 27, but instead through the multiplexing of a non-actuating data stream 31 into the image data stream 15 to create any number 1-N of "virtual" enable groups within the thermal elements 5. The non-actuating data stream 31 is comprised entirely of a sequence of "0s". Consequently, the NAND gates receiving the non-actuating data stream 31 remain continuously open, thereby preventing their respective thermal elements 5 from becoming actuated. The printhead 29 of the invention also includes a voltage sensor 34 connected between the output of the power source 7 and the termination of the switching gate 9 for a purpose which will be explained shortly.

The specific manner in which the printhead 29 implements the method of the invention via microprocessor 17 is best understood by way of a specific example. Let us suppose that the printhead 29 of the invention is connected to a power source 7 having a maximum current output of 6.5 amps at 24 volts. Prior to a printing operating, the microprocessor 17 determines the maximum power output of the source 7 by sequentially actuating as many of the thermal elements 5 as it can before the voltage sensor 34 indicates a drop in the output voltage via a conductor 35 connected to an input of the microprocessor 17. In this specific example, since each thermal element requires 43 milliamps at 24 volts to operate, the microprocessor will determine that the maximum number of elements that can be actuated with the 6.5 amp source 7 is 135. Hence, the maximum enable group that a 6.5 amp power source 7 can accommodate at any one time is 135 thermal elements. Because it is desirable for all of the enable groups to be of equal size (since unevenly sized enable groups would only strain the capacity of the power source 7 without any concurrent increase in printing speed), the microprocessor next proceeds to determine the number of enable groups that the power source 7 can easily handle by dividing the number of thermal elements in the maximum-sized enable group into the total number of elements. In the present example, since the maximum-size enable group is 135 elements, and the total number of elements is 512, the resulting quotient is 3.79. Since it is desirable for each of the enable groups to be of the same size, this quotient is rounded up into the next integer, i.e, from 3.79 to 4.

After the commencement of a printing operation, the microprocessor then proceeds to multiplex streams of non-actuating data 31 into the stream of image data 15 to create virtual enable groups. This concept is perhaps most easily seen in the graph of FIG. 6. Because the microprocessor 17 wishes to create the equivalent of four enable groups, it multiplexes non-enabling data (equivalent to a string of "0s") into the image data at a 3 to 1 ratio. Such multiplexing allows 64 bits of image data to be transmitted to heating elements 1–128 while all of the remaining elements 129–512 receive 64 bits of non-actuating data that prevents these elements from heating. After each of the heating elements 1–128 has received 64 bits of image data, the microprocessor next allows heating elements 129–256 to receive 64 bits of image data while the remaining heating elements 1–128 and 257–512 each receive 64 bits of non-actuating "0s". These steps of the method of the invention are repeated until all 512 heating elements have received 64 bits of image data. Once this has occurred, the paper 20 is advanced one step relative to the printhead 3, and the method is repeated until another line of the image has been printed.

While the method of the invention may be implemented by the serial actuation of all of the thermal elements 5 in one of the four different enable groups, a more preferred method of the invention is the actuation of one or more of the thermal elements 4 in each of the enable groups. For example, it is more preferred that thirty-two of the thermal elements 5 in each of the four virtual enable groups be simultaneously actuated with image data, instead of the actuation of all 128 thermal elements in a single one of the four enable groups. Such an actuation scheme fulfills the condition that not more than 128 thermal elements be actuated at any one time during the printing operation while advantageously achieving a more uniform distribution of thermal printing across the printhead 3. The more uniform distribution of heat from the thermal elements in turn minimizes undesired "border pixel" effects wherein colors near the borders of the enable groups are unintentionally printed in darker tones than desired due to the aggregate amount of heat generated by the simultaneous actuation of all of the thermal elements 5 along a specific length of the thermal printhead 3.

While the invention has been described in the context of specific embodiments of both the apparatus and the method, various modifications, advantages, and additions to the invention may become evident to persons of skill in the art. For example, while the drain leads of the NAND gates are all preferably interconnected so as to continuously receive a "1" switch closing signal to the gates, the method of the invention could also be implemented in a prior art printhead hard-wired for a specific number of enable groups by merely programming the computer 17 to continuously transmit "1" switch closing signals to the NAND gates 9 via the multiplex wiring 27 that exists in such printheads 3. Additionally, to further prevent any unwanted "border pixel" affects, the image data could be randomly distributed to heating elements 5 in all of the enable groups, so long as the total number of heating elements receiving image data is no greater than the number of heating elements in each of the calculated enable groups. All such variations, additions, advantages, and modifications are intended to fall within the scope of this invention, which is limited only by the claims appended hereto.

Parts List

1. Printer
3. Printhead
5. Thermal elements
7. Power source
8. NAND gates
9. Switching gate assembly
10. Latch circuit assembly
11. Latch circuits
12. Gates
13. Shift register
15. Image data stream
17. Microprocessor
20. Paper printing medium
22. Dye ribbon
24. Platen roll
25. Motor
26. Enable groups a-d
27. Enable wiring group
28. Multiplex signals
29. Printhead of the invention
30. Enablement conductor
31. Non-actuating data system
32. Dynamic enable groups
34. Current sensor
35. Signal

What is claimed is:

1. A method for sizing and operating enable groups of thermal elements in a thermal printer wherein each element is actuated by a power source in response to signals generated by image data, comprising the steps of:

determining the maximum number of thermal elements actuatable by a maximum power output of said source, and introducing non-actuating data into said image data so that the number of thermal elements actuatable by said image data is no greater than said maximum number of thermal elements at any time during a printing operation.

2. The method of sizing and operating enable groups as defined in claim 1, wherein said thermal elements are each actuated by a serial stream of image data, and wherein a stream of non-actuating data is multiplexed into said serial streams of image data.

3. The method of sizing and operating enable groups as defined in claim 1, wherein said maximum number of thermal elements is calculated by dividing the amperage available from said maximum power output by the amperage required by an actuated thermal element.

4. The method of sizing and operating enable groups as defined in claim 1, wherein an enable group size is calculated by dividing the amperage available from said maximum power output by the amperage required by a single actuated thermal element, and then by reducing said maximum number of thermal elements until the resulting number divided into the total number of thermal elements approximately equals an integer.

5. The method of sizing and operating enable groups as defined in claim 1, wherein said enable group size is initially calculated by dividing the amperage available from said maximum power output by the amperage required by an actuated thermal element, dividing the initially calculated group size into the total number of thermal elements, and rounding up the quotient number obtained by said division to the nearest integer to calculate the number of enablement groups, and finally by dividing said integer into said total number of thermal elements to obtain a final group size.

6. The method of sizing and operating enable groups as defined in claim 1, wherein said thermal elements are arranged in a row to print a single line of an image onto a medium, and further including the step of dividing said thermal elements into mutually exclusive enable groups, each having a size that is equal to or less than said calculated maximum number of thermal elements.

7. The method of sizing and operating enable groups as defined in claim 6, wherein only one of said enable groups is actuated by said image data at any one time while the remainder of said enable groups are maintained in a non-actuated state by said non-actuating data.

8. The method of sizing and operating enable groups as defined in claim 6, wherein some of the thermal elements of each of said enable groups is actuated by said image data an any one time while the remainder of said thermal elements are maintained in a non-actuated state by said non-actuating data.

9. The method of sizing and operating enable groups as defined in claim 6, wherein said printer includes, for each thermal element, a switch for controlling a flow of electric current through said element from said power source, a latch for opening and closing said switch in response to a data bit, and a shift register for receiving image data and non-actuating data from a processor and conducting a serial stream of bits of said data to said latch, and wherein said processor multiplexes said image data and non-actuating data such that the number of thermal elements actuated by said image data is no larger than the number of thermal elements in an enable group.

10. The method of sizing and operating enable groups as defined in claim 9, wherein said processor multiplexes said data such that some of the thermal elements of each of said enable groups is actuated by said image data at any one time while the remainder of said thermal elements are maintained in a non-actuated state by said non-actuating data.

11. A method for sizing and operating enable groups of thermal elements in a thermal printer wherein each element is operated by a switch that connects and disconnects the element from a power source, each switch being controlled by a latch which in turn is controlled by bits from a serial stream of image data, comprising the steps of:

determining the maximum number of thermal elements that a maximum output of the power source can actuate at one time;

dividing said maximum number into the total number of thermal elements;

rounding up the quotient of said division to the nearest integer and dividing said total number of elements by said integer to obtain a size of an enable group, and introducing streams of non-actuating data into said stream of image data so that the number of thermal elements actuatable by said image data is no greater than the number of thermal elements in said enable group at any time during a printing operation.

12. The method of sizing and operating enable groups as defined in claim 11, further comprising the step of assigning each of said thermal elements to a single one of a plurality of mutually exclusive, substantially equally sized enable groups.

13. The method of sizing and operating enable groups as defined in claim 12, further including the step of multiplexing said streams of non-actuating data into said stream of image data such that some thermal elements in all enable groups are actuatable by said image data at any one time.

14. The method of sizing and operating enable groups as defined in claim 12, further including the step of multiplexing said stream of non-actuating data into said stream of image data such that all of the thermal elements in one of said enable groups are actuatable at one time.

15. The method of sizing and operating enable groups as defined in claim 11, wherein said thermal elements are arranged in a single row to print a single line of an image onto a medium, and wherein said printer includes a shift register for receiving said streams of image data and non-actuating data and for serially providing bits of said data to each of said latches to control said latches, and further comprising the step of dividing up said thermal elements into mutually exclusive enable groups.

16. A thermal printing apparatus, comprising:

a power source;

a row of thermal elements actuatable by said power source in response to signals generated by a stream of image data;

a sensor connected to an output of said power source for determining a maximum output of said source, and a processor connected to an output of said sensor for determining the maximum number of thermal elements actuatable by said maximum output of said power source, and for multiplexing non-actuating data streams into said image data stream during a printing operation such that the number of thermal elements actuatable is no more than said maximum number of elements.

17. The thermal printing apparatus as defined in claim 16, wherein said processor determines an enable group size by dividing said maximum number of elements into the total number of elements, rounding up the resulting quotient to the nearest integer, and dividing said integer into the total number of thermal elements.

18. The thermal printing apparatus as defined in claim 17, wherein said processor divides all of said thermal elements into enable groups that are mutually exclusive.

19. The thermal printing apparatus as defined in claim 18, wherein said process multiplexes said non-actuating data into said image data such that some of said elements of each group are actuatable at all times during a printing operation.

20. The thermal printing apparatus as defined in claim 16, wherein said sensor is a current sensor.

* * * * *